United States Patent [19]

Cook et al.

[11] 4,138,799

[45] Feb. 13, 1979

[54] TOY PLANE WITH PARACHUTE AND LAUNCHER

[75] Inventors: Calvin S. Cook; Carl J. Merl, both of Erie, Pa.

[73] Assignee: Louis Marx & Co., Inc., Stamford, Conn.

[21] Appl. No.: 760,615

[22] Filed: Jan. 19, 1977

[51] Int. Cl.[2] ..... A63H 33/20

[52] U.S. Cl. ..... 46/86 R

[58] Field of Search ..... 46/86 R, 86 A, 86 B, 46/86 C

[56] References Cited

U.S. PATENT DOCUMENTS

| | | | |
|---|---|---|---|
| 3,365,836 | 1/1968 | Lim | 46/86 R |
| 3,465,472 | 9/1969 | Novotny | 46/86 R |
| 3,995,392 | 12/1976 | Goldfarb et al. | 46/83 |

FOREIGN PATENT DOCUMENTS

| | | | |
|---|---|---|---|
| 1189589 | 3/1959 | France | 46/86 C |

*Primary Examiner*—Louis G. Mancene
*Assistant Examiner*—Robert F. Cutting
*Attorney, Agent, or Firm*—Blum, Moscovitz, Friedman & Kaplan

[57] ABSTRACT

A toy plane and launcher set in which the plane can be launched into flight by means of the launcher is provided with a parachute for permitting the plane to float to earth. Means are provided at the apex of the parachute to carry the parachute in a closed mode during flight of the plane with such means being disconnectable from the plane as the plane commences its fall toward earth under the force of gravity thereby permitting the parachute to open.

12 Claims, 4 Drawing Figures

3
3

TOY PLANE WITH PARACHUTE AND LAUNCHER

BACKGROUND OF THE INVENTION

This invention constitutes an improvement over the toy vehicle flying set disclosed in U.S. Pat. No. 3,995,392 issued Dec. 7, 1976. Flying toys or objects with parachutes have long been known in the art. The principal problem encountered with parachute toys is the ability to maintain the parachute in closed condition while the toy is propelled into the air so as not to apply a drag force while permitting the parachute to open to perform its normal function after the object has reached the apogee of its flight. The present invention embodies an improvement to overcome the prior art problems in conjunction with the toy flying vehicle set disclosed in U.S. Pat. No. 3,995,392.

SUMMARY OF THE INVENTION

Generally speaking, in accordance with the invention, a toy plane which is capable of being launched by a launcher has a parachute attached to the plane at the ends of the shroud lines. The apex of the parachute canopy is provided with releasable means for attaching the apex to the plane in order that the parachute canopy may be carried along in closed condition with the plane when the plane is propelled into the air. The means are such that, after the plane reaches the apogee of its flight and commences a fall toward earth, the apex of the canopy disconnects from the plane and the canopy is free to open. Means are provided on the launcher to hold the canopy in a closed mode immediately prior to launching of the plane.

Accordingly, it is an object of this invention to provide a toy plane and launching set with a parachute operable to provide improved play value.

A further object of the invention is to provide improved means for holding a parachute canopy in a closed mode until a launched object has passed the apogee of its flight.

Still another object of the invention is to provide means for adding an operable parachute arrangement to a known toy flying vehicle set.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2:
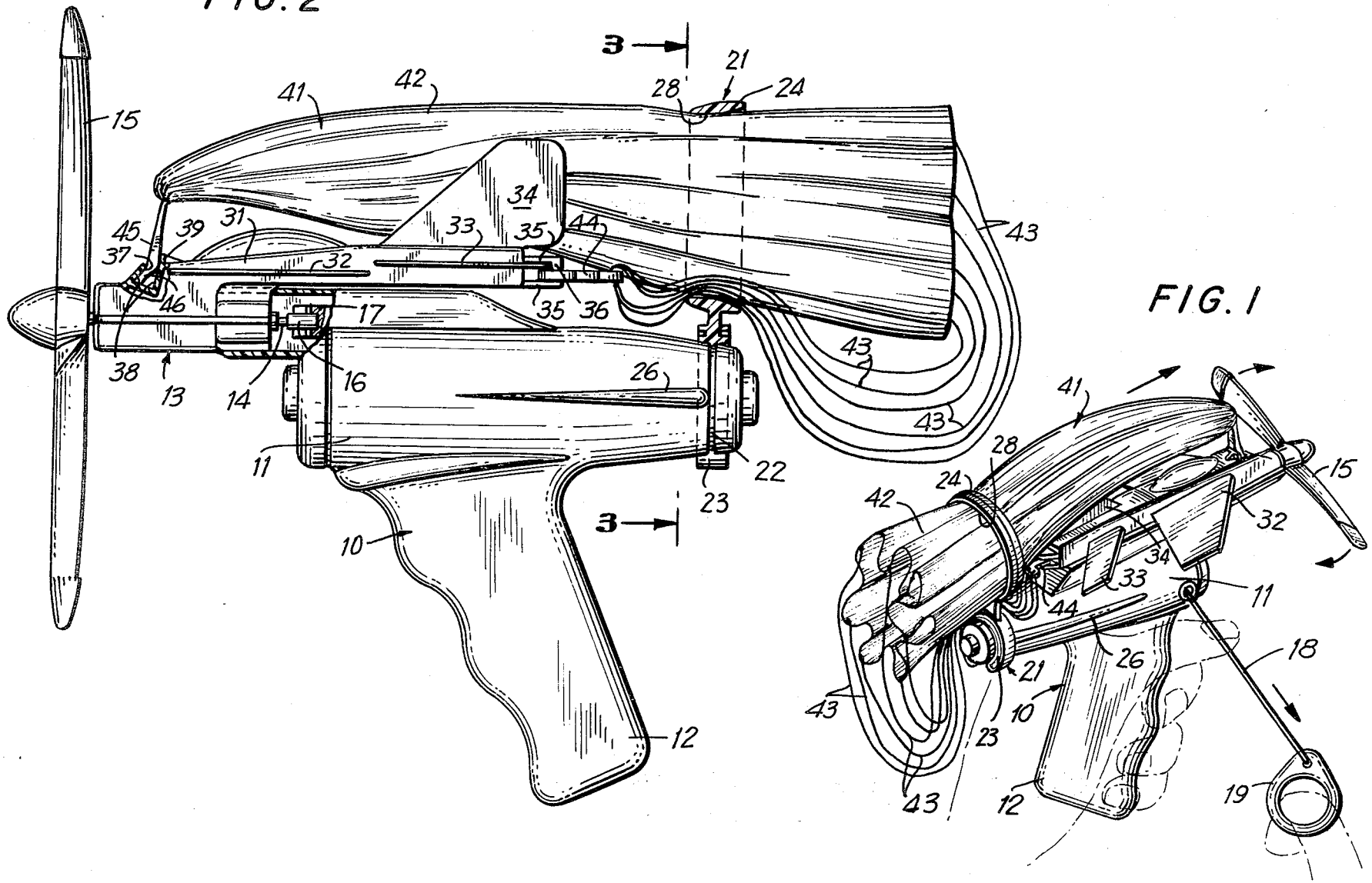
FIG. 1 is a perspective view of a toy plane with parachute and launcher in a launching mode as launching is about to take place.
FIG. 2 is an elevational view of a toy plane mounted on a launcher with the parachute canopy in a folded mode.

U.S. Pat. No. 3,995,392 issued Dec. 7, 1976 discloses a toy flying vehicle set consisting of a launcher which is adapted to be handheld and a toy plane which is releasably mounted on the launcher. The launcher includes means for rotating the propeller of the plane at a high rate of speed whereby the propeller pulls the plane from the launcher and causes it to fly through the air. The instant invention constitutes an improvement over the toy flying vehicle set shown in U.S. Pat. No. 3,995,392 in that means have been provided to add a parachute to the set which has minimal interference with the plane during flight but which permits the plane to float to the earth under the parachute after it has reached the apogee of its flight.

Referring now to the drawings, the launcher and plane are generally of a construction as disclosed in U.S. Pat. No. 3,995,392. The launcher is generally indicated at 10 and comprises a main housing 11 and a handle portion 12. A toy plane 13 is slidably positionable on main housing 11. The plane is provided with a shaft 14 having a propeller 15 affixed at one end thereof and a coupling mechanism 16 affixed at the other end of shaft 14. The coupling mechanism is in releasable engagement with a drive mechanism 17 which is rotated at a high rate of speed as a result of a quick pull on a pull string 18 through a ring 19. A preferred mechanism by which pull string 18 rotates drive mechanism 17 and a preferred manner of mounting plane 13 onto main housing 11 are amply described in U.S. Pat. No. 3,995,392 and such portions of the description in said patent as are required for an understanding of the instant invention are incorporated herein by reference.

Figure 3:
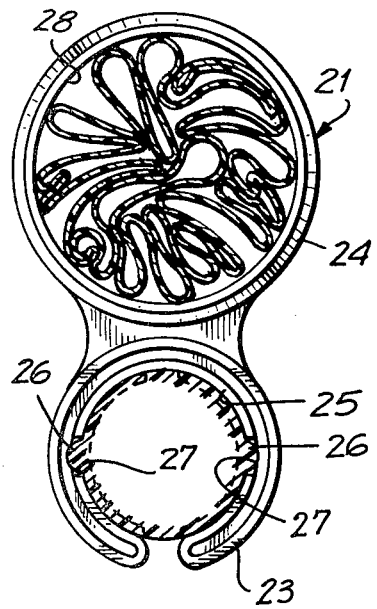
FIG. 3 is a sectional view taken along line 3—3 of FIG. 2.

A parachute support member 21 is removably mounted on main housing 11. The main housing is provided with an annular groove 22 for cooperation with parachute support member 21. Member 21 is preferably molded of resilient plastic and comprises a snap on portion 23 and a ring 24. Portion 23 is formed as an incomplete circle as best shown in FIG. 3 and is provided with a radially inwardly extending ridge 25 for engagement in annular groove 22. Main housing 11 is preferably provided with outwardly extending ribs 26 and mating recesses 27 are provided in snap on portion 23 for proper positioning of parachute support member 21. Due to the resilient construction of snap on portion 23, it can be readily applied to and removed from main housing 11 of launcher 10. When in position, ridge 25 engages in annular groove 22 and recesses 27 receive ribs 26 to thereby securely position parachute support member 21 on launcher 10 in the correct position as shown in FIGS. 2 and 3. When a launcher and plane are to be used without the parachute, parachute support member 21 may be removed.

Ring 24 is formed as a circular member with the inner surface 28 preferably having the configuration of a truncated cone with the narrow end being positioned toward the front so that the parachute can be readily withdrawn from ring 24 as will be hereafter described.

Plane 13 has a fuselage body 31 to which are mounted wings 32, elevators 33 and a rudder 34. The tail end of body 31 is formed with a pair of spaced plates 35 joined at the outer ends by a post 36 to provide removable parachute attaching means to be described below. The forward end of body 31 proximate propeller 15 is provided with a slot 37 which has spaced walls 38 which slope at an acute angle to the longitudinal extent of body 31 as best seen in FIG. 2. Adjacent the rear end of slot 37 is an upstanding lip 39.

A parachute is generally indicated at 41 and includes a canopy 42 and a plurality of shroud lines 43. The shroud lines are joined at one end to the peripheral edge of canopy 42 and at the other end to a hook member 44 which releasably connects to post 36. The apex of canopy 42 has secured thereto an arm 45. The cross sectional configuration of arm 45 is shown in FIG. 2. Arm 45 tapers from a narrow portion at its connection to canopy 42 to a point intermediate the ends of arm 45 to define a wedge shaped portion. A finger 46 extends beyond the widest part of the wedge of arm 45 at an angle thereto.

Use of the invention herein disclosed may now be described. Parachute support member 21 is mounted on to launcher 10 and hook member 44 is hooked to post 36. Plane 13 is mounted on to the launcher and the parachute canopy and shroud lines are carefully folded and positioned within ring 24 as best seen in FIGS. 1 and 2. Arm 45 is then inserted into slot 37 with finger 46 extending forward to engage the forward and lowermost corner of slot 37. Because of the configuration of slot 37 and arm 45, a rearward pull on the canopy will cause arm 45 to temporarily lock into slot 37 with a portion of the arm bearing against lip 39. In this position, the launching of the plane by means of a rapid pull on ring 19 will cause the plane to pull the parachute out of ring 24. The rearward drag force on the parachute canopy as the plane approaches the apogee of its flight will maintain a rearward pull on arm 45 so as to maintain the arm in slot 37. In this manner the canopy is pulled from its apex and is thus held closed so as not to interfere with the flight of the plane.

Figure 4:
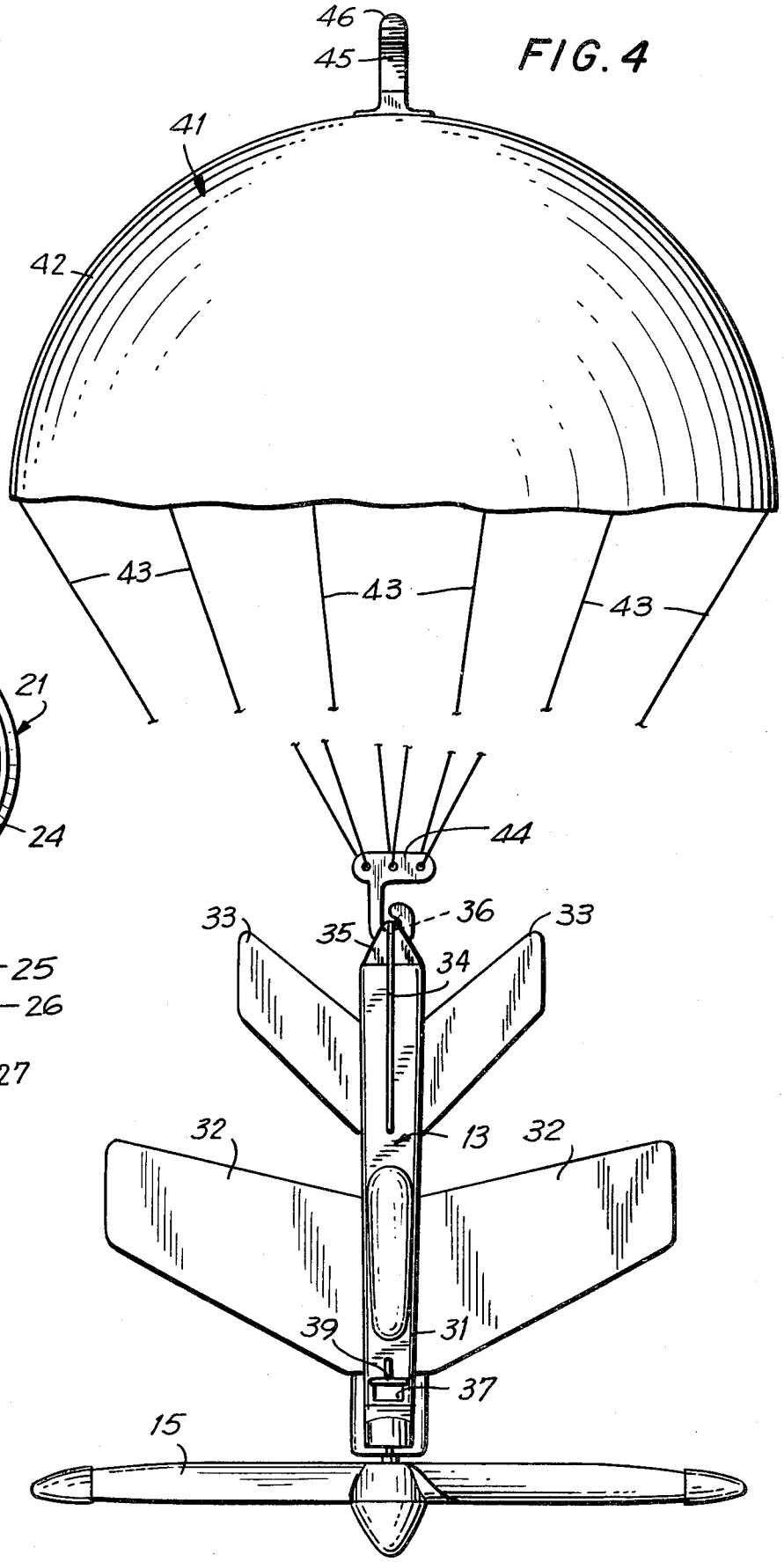
FIG. 4 is an elevational view of a toy plane and parachute as it would appear during flight descent.

When the plane reaches the apogee of its flight, it will fall toward earth under gravity. As the plane falls, the drag force previously applied to the canopy will discontinue and eliminate the locking action between arm 45 and slot 37. Since the canopy presents a greater surface area than the plane, the plane will tend to fall faster and cause the canopy to be pulled through the shroud lines to thereby open in the manner of a parachute. The plane under the parachute will then fall toward earth as shown in FIG. 4.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a combination with a launcher and a flying vehicle adapted to be launched into the air by the launcher, said flying vehicle having a body, the improvement comprising a parachute having a canopy, shroud lines and means for connecting said canopy to said body through said shroud lines at a first shroud connecting position, a parachute support member carried by said launcher and parachute pulling means acting between said canopy and said body for releasably connecting said canopy to said body at a second parachute pulling position during a first portion of vehicle flight whereby said canopy may be pulled in a closed mode during travel of said vehicle from launching to the apogee of its flight and said parachute pulling means is released as said flying vehicle descends with said canopy opened and connected to said flying vehicle only at said first position.

2. The combination as claimed in claim 1 wherein said parachute support member comprises a ring member and a support portion for connecting said ring member to said launcher in spaced relationship thereto.

3. The combination as claimed in claim 2 wherein said support portion is generally resilient for snap on engagement with said launcher and includes means acting between said support portion and said launcher for positioning said parachute support member in a preselected position with respect to said launcher.

4. The combination as claimed in claim 2 wherein said ring member has a circular inner surface having the general configuration of a truncated cone.

5. The combination as claimed in claim 1 wherein said parachute pulling means comprises a projecting piece carried by said canopy substantially at the apex thereof and a receiving portion on said body at said second position.

6. The combination as claimed in claim 5 wherein said receiving portion is positioned on said body as respects the direction of vehicle flight forward of the position at which said shroud lines are connected to said body through said connecting means.

7. The combination as claimed in claim 6 wherein said receiving portion is formed as a slot in said body.

8. The combination as claimed in claim 7 wherein said slot is defined by a pair of walls which extend transversely of the longitudinal axis of said body, the forward wall of said pair of walls sloping forwardly from its point of intersection with the surface of said body.

9. The combination as claimed in claim 8 wherein said projecting piece includes a wedged shape arm joined at its narrowest portion to said canopy and a finger extending outwardly beyond the widest portion of said wedge.

10. The combination as claimed in claim 9 wherein said finger extends at an angle to the longitudinal axis of said wedge shape arm.

11. The combination as claimed in claim 1 wherein said connecting means includes a hook and said body is provided with hook receiving means at said first position for releasably connecting said hook to said body.

12. The combination as claimed in claim 11 wherein said hook receiving means is located at the rear end of said body and comprises a pair of spaced plates and a post extending therebetween.

* * * * *